US010256575B2

(12) United States Patent
Kato et al.

(10) Patent No.: US 10,256,575 B2
(45) Date of Patent: Apr. 9, 2019

(54) CONNECTOR INCLUDING CIRCUIT PROTECTION COMPONENT AND THERMAL CONDUCTOR

(71) Applicant: Yazaki Corporation, Tokyo (JP)

(72) Inventors: Hajime Kato, Shizuoka (JP); Haruhiko Yokoyama, Shizuoka (JP); Takaaki Miyajima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/697,166

(22) Filed: Sep. 6, 2017

(65) Prior Publication Data

US 2018/0069349 A1 Mar. 8, 2018

(30) Foreign Application Priority Data

Sep. 8, 2016 (JP) ..... 2016-175189

(51) Int. Cl.
*H01R 13/684* (2011.01)
*H01R 13/6581* (2011.01)
(Continued)

(52) U.S. Cl.
CPC ..... *H01R 13/6581* (2013.01); *H01H 85/202* (2013.01); *H01H 85/47* (2013.01); *H01R 13/6588* (2013.01); *H01R 4/34* (2013.01); *H01R 13/6666* (2013.01); *H01R 13/68* (2013.01); *H01R 13/684* (2013.01); *H01R 13/688* (2013.01); *H01R 24/20* (2013.01)

(58) Field of Classification Search
CPC .. H01R 13/6666; H01R 13/68; H01R 13/684; H01R 13/688; H01R 25/03
USPC ..... 439/485, 620.26, 620.28, 620.3, 620.32
See application file for complete search history.

(56) References Cited

U.S. PATENT DOCUMENTS

2014/0148045 A1* 5/2014 Kashiwada ..... H01R 13/6592 439/485
2016/0104974 A1 4/2016 Yamaguchi

FOREIGN PATENT DOCUMENTS

CN 103855488 A 6/2014
CN 105264720 A 1/2016
(Continued)

OTHER PUBLICATIONS

Japanese Office Action for the related Japanese Patent Application No. 2016-175189 dated Jul. 24, 2018.
(Continued)

*Primary Examiner* — Abdullah A Riyami
*Assistant Examiner* — Justin M Kratt
(74) *Attorney, Agent, or Firm* — Kenealy Vaidya LLP

(57) ABSTRACT

A connector includes a housing body, a shield shell that externally covers the housing body, a first connection terminal that is housed in the housing body, electrically connected to a first wire in the housing body, and electrically connected to a counterpart terminal when the connector is connected to a counterpart connector, and a circuit protection component that is interposed, in the housing body, between the first connection terminal and the first wire, and connects the first connection terminal and the first wire in series to protect a circuit. The housing body includes at least one thermal conductor that performs thermal conduction with the circuit protection component by being in contact with the circuit protection component.

16 Claims, 6 Drawing Sheets

(51) Int. Cl.

| | |
|---|---|
| ***H01H 85/20*** | (2006.01) |
| ***H01H 85/47*** | (2006.01) |
| ***H01R 13/6588*** | (2011.01) |
| *H01R 13/688* | (2011.01) |
| *H01R 13/68* | (2011.01) |
| *H01R 13/66* | (2006.01) |
| *H01R 4/34* | (2006.01) |
| *H01R 24/20* | (2011.01) |

(56) References Cited

FOREIGN PATENT DOCUMENTS

| | | | |
|---|---|---|---|
| JP | 2014-107151 | A | 6/2014 |
| JP | 2014-241203 | A | 12/2014 |
| JP | 2015-5397 | A | 1/2015 |

OTHER PUBLICATIONS

Chinese Office Action for the related Chinese Patent Application No. 201710799861.4 dated Nov. 28, 2018.

* cited by examiner

CONNECTOR INCLUDING CIRCUIT PROTECTION COMPONENT AND THERMAL CONDUCTOR

CROSS-REFERENCE TO RELATED APPLICATION(S)

The present application claims priority to and incorporates by reference the entire contents of Japanese Patent Application No. 2016-175189 filed in Japan on Sep. 8, 2016.

BACKGROUND OF THE INVENTION

1. Field of the Invention

The present invention relates to a connector.

2. Description of the Related Art

Connectors have been known that electrically connect, in their housings, terminals provided inside the housings and wires pulled out outside the housings, and protect circuits on energizing paths including the terminals and the wires with circuit protection components interposed between the terminals and the wires. Such connectors are disclosed in Japanese Patent Application Laid-open No. 2014-241203, Japanese Patent Application Laid-open No. 2015-5397, and Japanese Patent Application Laid-open No. 2014-107151, for example. Those connectors include fuses serving as the circuit protection components, and heat dissipation structures that release heat of fuse main bodies (cartridges) serving as heat generation sources outside the housings. For example, the connectors disclosed in Japanese Patent Application Laid-open No. 2014-241203 and Japanese Patent Application Laid-open No. 2015-5397 each include a holding member holding a fuse via a fuse main body, and externally release heat of the fuse via the holding member a part of which is in contact with a shield shell. For another example, the connector disclosed in Japanese Patent Application Laid-open No. 2014-107151 includes a heat dissipation member covering a fuse main body, and externally releases heat of a fuse via the heat dissipation member a part of which is in contact with the housing.

The conventional connectors require dedicated components (such as the holding member and the heat dissipation member) that release heat of the circuit protection component, thereby causing the number of components to be increased for enhancing heat releasing property.

SUMMARY OF THE INVENTION

The present invention aims to provide a connector that can achieve heat releasing property while preventing an increase in the number of components for releasing heat.

In order to achieve the above mentioned object, a connector according to one aspect of the present invention includes a housing body; a shield shell that externally covers the housing body; a connection terminal that is housed in the housing body, the connection terminal being electrically connected to a wire in the housing body, and electrically connected to a counterpart terminal when the connector is connected to a counterpart connector; and a circuit protection component that is interposed, in the housing body, between the connection terminal and the wire, and connects the connection terminal and the wire in series to protect a circuit, wherein the housing body includes at least one thermal conductor that performs thermal conduction with the circuit protection component by being in contact with the circuit protection component.

According to another aspect of the present invention, in the connector, it is possible to configure that thermal conductor includes at least one elastic piece that has a piece shape and is bent when the elastic piece is in contact with the circuit protection component.

According to still another aspect of the present invention, in the connector, it is possible to further include that a first coupling conductor that electrically couples the circuit protection component to the connection terminal; and a second coupling conductor that electrically couples the circuit protection component to the wire, wherein the circuit protection component includes a main body including a circuit protector, a first conductor that is electrically connected to the circuit protector and electrically connected to the first coupling conductor, and a second conductor that is electrically connected to the circuit protector and electrically connected to the second coupling conductor, and the thermal conductor is formed such that the thermal conductor is capable of receiving heat of at least one of the first and the second conductors.

According to still another aspect of the present invention, in the connector, it is possible to further include that a first coupling conductor that electrically couples the circuit protection component to the connection terminal; and a second coupling conductor that electrically couples the circuit protection component to the wire, wherein the circuit protection component includes a main body including a circuit protector, a first conductor that is electrically connected to the circuit protector, a second conductor that is electrically connected to the circuit protector, a first coupling portion that is electrically connected to the first conductor and the first coupling conductor, and a second coupling portion that is electrically connected to the second conductor and the second coupling conductor, and the thermal conductor includes a first thermal conductor to which heat of the first conductor is conducted, a second thermal conductor to which heat of the second conductor is conducted, a third thermal conductor to which heat of the first coupling portion is conducted, and a fourth thermal conductor to which heat of the second coupling portion is conducted.

According to still another aspect of the present invention, in the connector, it is possible to further include that a terminal side joining member that joins the first coupling conductor to the first coupling portion; and a wire side joining member that joins the second coupling conductor to the second coupling portion, wherein the first thermal conductor is in contact with the first conductor, the second thermal conductor is in contact with the second conductor, the third thermal conductor is in contact with the terminal side joining member, and the fourth thermal conductor is in contact with the wire side joining member.

According to still another aspect of the present invention, in the connector, it is possible to configure that the circuit protection component is a fuse.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes an embodiment of a connector according to the present invention in detail with reference to the accompanying drawings. The embodiment does not limit the invention.

Embodiment

The following describes the embodiment of the connector according to the present invention with reference to FIGS. 1 to 6.

Figure 1:
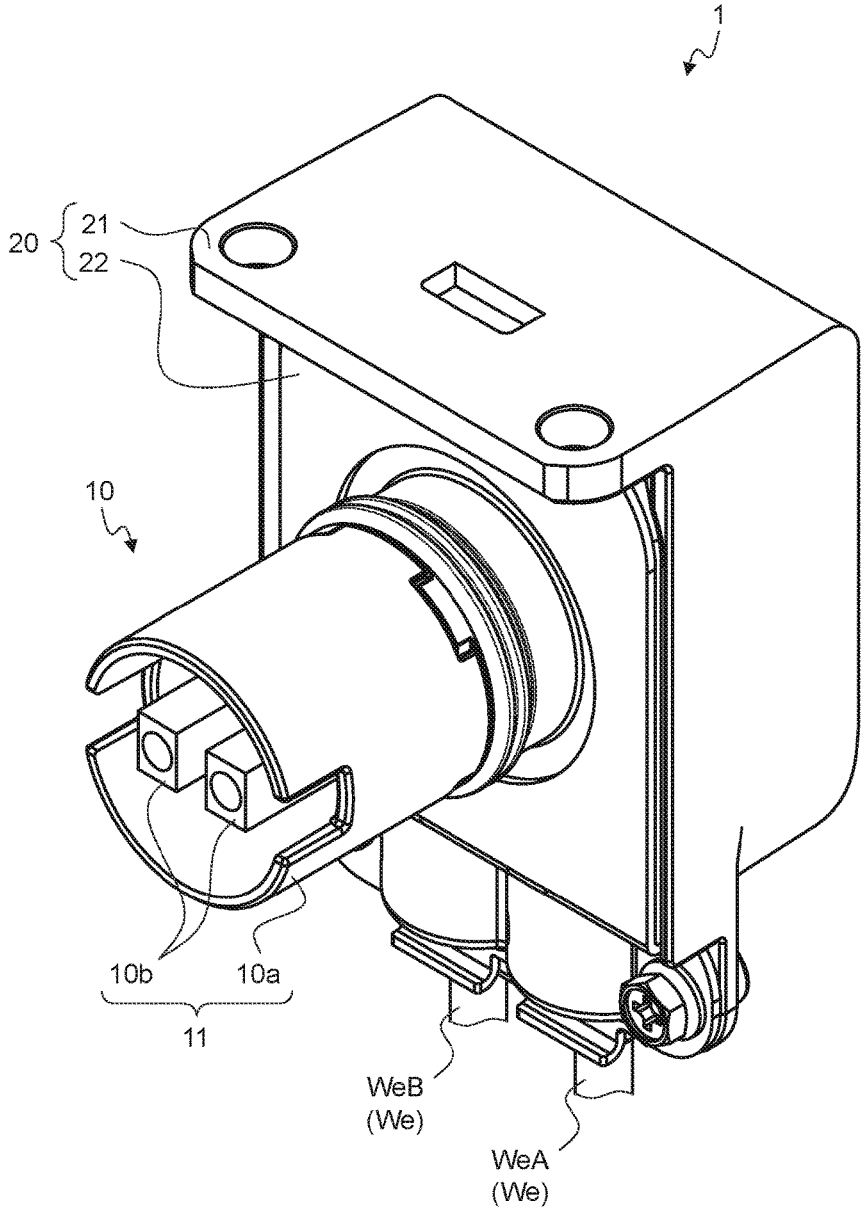
FIG. 1 is a perspective view illustrating a connector in an embodiment.
Figure 2:
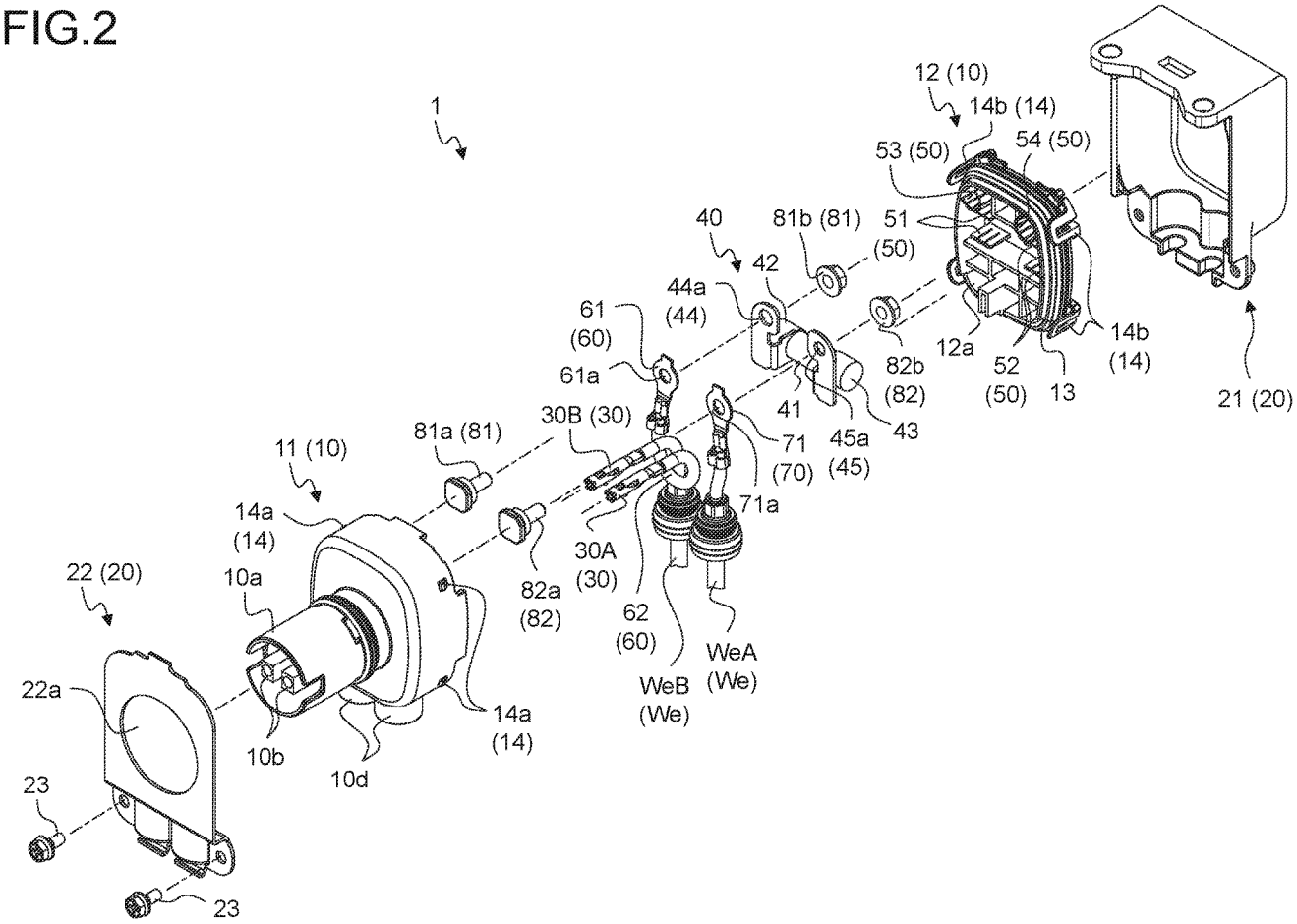
FIG. 2 is an exploded perspective view illustrating the connector in the embodiment.
Figure 3:
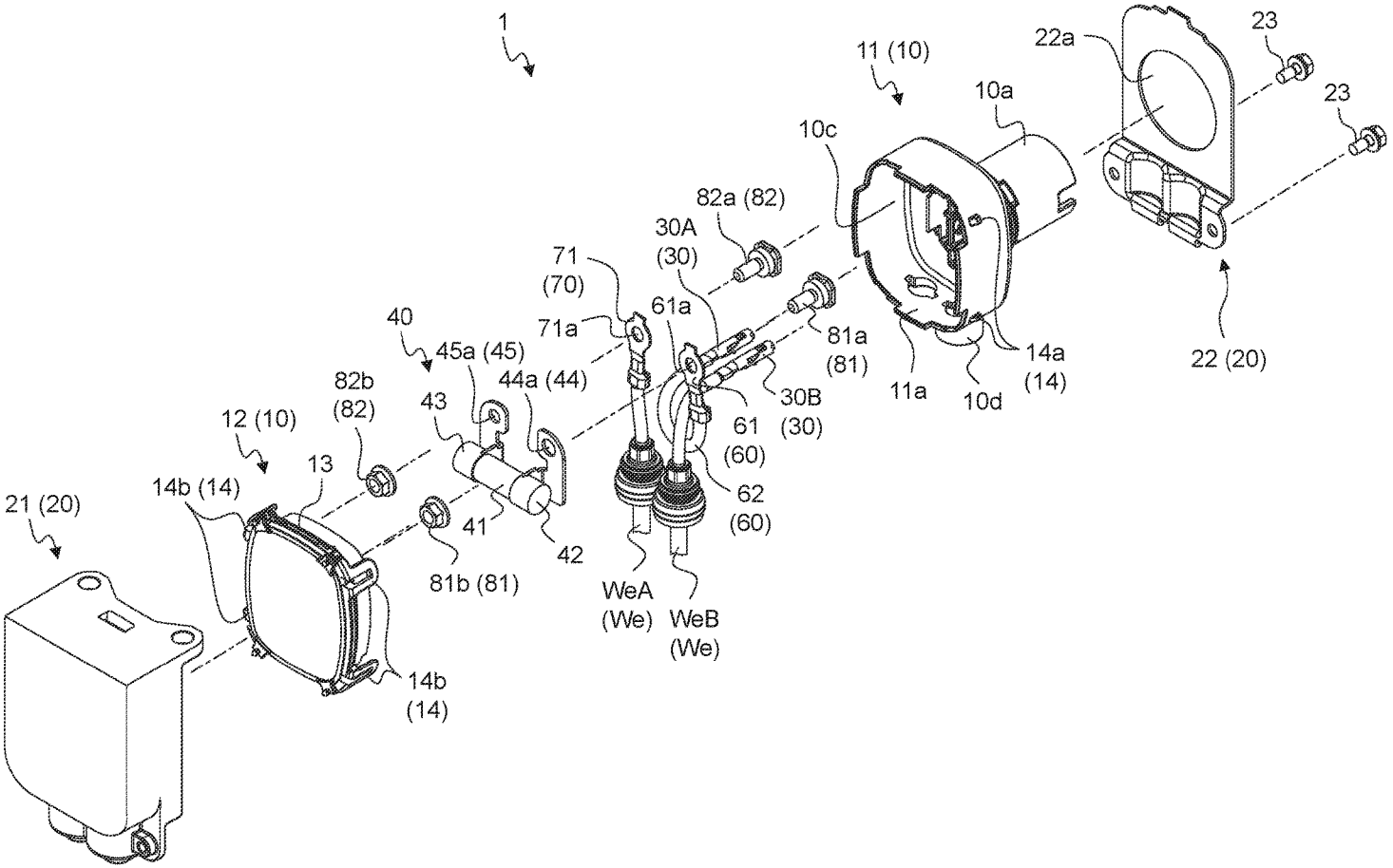
FIG. 3 is an exploded perspective view illustrating the connector in the embodiment viewed from another angle.

FIGS. 1 to 3 illustrate a connector 1 according to the embodiment. The connector 1 is what is called a shield connector. The connector 1 includes a housing body 10, a shield shell 20, and connection terminals 30.

The housing body 10 has a box-shape and houses therein the connection terminals 30 and electrical connection portions between the connection terminals 30 and wires We. The housing body 10 is formed from an insulating material such as a synthetic resin.

The housing body 10 has a fitting portion 10*a* (refer to FIGS. 1 to 3) that is fitted to a housing body of a counterpart connector (not illustrated). At the fitting, the connector 1 and the counterpart connector are physically connected to each other. As a result, the connection terminals 30 and terminals of the counterpart connector are physically and electrically connected. The fitting portion 10*a* exemplarily illustrated herein is formed in a tubular shape projecting from the housing body 10 and having an opening at one end thereof in a tube axial direction, and is disposed such that the opening faces the counterpart connector. In the housing body 10, the tube axial direction of the fitting portion 10*a* is an insertion-extraction direction of the connector 1 relative to the counterpart connector (hereinafter, described as a "connector insertion-extraction direction"). An insertion direction of the connector 1 relative to the counterpart connector is described as a connector insertion direction.

Inside the fitting portion 10*a* of the housing body 10, terminal housings 10*b* are arranged (refer to FIGS. 1 and 2). The terminal housing 10*b* forms therein an inner space serving as a terminal compartment housing the connection terminal 30, and has an opening on both sides of the terminal compartment in the connector insertion-extraction direction. One opening communicates with a main space 10*c* (refer to FIG. 3) inside the housing body 10, and the other opening is disposed on the opening side of the fitting portion 10*a* and communicates with the outside of the housing body 10. The connection terminal 30 is inserted into the terminal compartment from the one opening of the terminal compartment along the connector insertion-extraction direction after being passed through the main space 10*c*. The counterpart terminal is inserted into the terminal compartment from the other opening of the terminal compartment along the connector insertion-extraction direction, and is physically and electrically connected to the connection terminal 30. The housing body 10 exemplarily illustrated herein includes the terminal housings 10*b* each provided for a corresponding one of the connection terminals 30.

Inside the housing body 10, the connection terminal 30 and the end of the wire We are electrically connected to each other. The electrical connection portion between the connection terminal 30 and the wire We is housed in the main space 10*c* of the housing body 10. The housing body 10 includes tubular wire lead-out portions 10*d* each having an inner space communicating with the main space 10*c* (refer to FIGS. 2 and 3). The wire We is pulled out externally from inside the housing body 10 through the wire lead-out portion 10*d*. The wire lead-out portion 10*d* is provided for each connection terminal 30.

The housing body 10 exemplarily illustrated herein has a division structure composed of a plurality of housing members. The housing body 10 is formed in a box shape by assembling the respective housing members. The housing body 10 includes a housing portion 11 serving as a first housing member and a cover 12 serving as a second housing member (refer to FIGS. 2 and 3).

The housing portion 11 is primarily a tubular body having an opening at one end thereof in the tube axial direction. The inner space of the housing portion 11 is utilized as the main space 10*c*. The housing portion 11 is formed such that the tube axial direction thereof is along the connector insertion-extraction direction. The housing portion 11 has the fitting portion 10*a* and the terminal housings 10*b* that project from the other end of the housing portion 11 in the tube axial direction. The connection terminals 30 are inserted into the main space 10*c* from an opening 11*a* (refer to FIG. 3) at the one end of the housing portion 11 in the tube axial direction. The housing portion 11 has the wire lead-out portions 10*d* projecting in a direction intersecting (in a direction perpendicular to) the tube axial direction.

The cover 12, which is a tubular body that covers the opening 11*a* of the housing portion 11, is formed such that the tube axial direction thereof is along the connector insertion-extraction direction. One end of the cover 12 in the tube axial direction is open while the other end of the cover 12 in the tube axial direction is closed. The cover 12 is fitted to the housing portion 11 by being inserted into the main space 10*c* from the opening 11*a* of the housing portion 11 in such a manner that an opening 12*a* at the one end (refer to FIG. 2) faces the opening 11*a*.

Between the housing portion 11 and the cover 12, an annular packing 13 is disposed for maintaining liquid tightness therebetween (refer to FIGS. 2 and 3). The packing 13 is attached to an outer circumferential surface of the cover 12. The packing 13 is also closely in contact with an inner circumferential surface of the housing portion 11 as a result of the fitting between the housing portion 11 and the cover 12, thereby filling an annular space between the inner circumferential surface of the housing portion 11 and the outer circumferential surface of the cover 12.

Between the housing portion 11 and the cover 12, a locking structure 14 for maintaining the fitting state therebetween is provided at a plurality of places (in this case, four places) (refer to FIGS. 2 and 3). The locking structure 14 includes a first engagement portion 14*a* provided to the housing portion 11 and a second engagement portion 14*b* provided to the cover 12. The first engagement portion 14*a* and the second engagement portion 14*b* engage with each other, thereby maintaining the fitting state between the housing portion 11 and the cover 12. The locking structure 14 includes a clawed projection and a locking portion (a through hole or a groove provided to a piece body) into which the clawed projection is inserted, for example. The locking portion locks the movement of the projection in a direction opposite to the fitting direction between the housing portion 11 and cover 12. In the example, the clawed projections serving as the first engagement portions 14*a* project from the outer circumferential surface of the housing portion 11. The locking portions serving as the second engagement portions 14*b* are provided at the respective positions with a distance therebetween on the outer circumferential surface of the cover 12.

The shield shell 20 is disposed such that the shield shell 20 externally covers the housing body 10. The shield shell 20 is made from a conductive material such as metal and formed in a box shape. The shield shell 20 prevents noise from invading the connection terminals 30 and the wires We provided inside the shield shell 20. The shield shell 20 exemplarily illustrated herein has a division structure composed of a plurality of shell members. The shield shell 20 is formed in a box shape by assembling the respective shell members. The shield shell 20 includes a first shell member 21 and a second shell member 22 (refer to FIGS. 1 to 3).

The first shell member 21 is a tubular body having an opening at one end thereof in the tube axial direction, and houses the housing body 10 in an inner space thereof. The housing body 10 is housed in the first shell member 21 exemplarily illustrated herein in such a manner that the cover 12 of the housing body 10 faces the first shell member 21. The second shell member 22 is primarily a plate that closes the opening of the first shell member 21. The second shell member 22 closes the opening of the first shell member 21 housing the housing body 10 from a side adjacent to the housing portion 11, and has a through hole 22*a* through which the fitting portion 10*a* is inserted. The first shell member 21 and the second shell member 22 are connected to each other with screw members 23, for example.

The connection terminal 30 is made from a conductive material such as metal and formed in a certain shape. In the embodiment, the connection terminals 30 of the connector 1 are formed as female terminals while the counterpart terminals are formed as male terminals. The connection terminals 30 and the counterpart terminals may be either the female terminals or the male terminals as long as they are fitted to each other and physically and electrically connected to each other. In the example, two connection terminals 30 are provided. The connection terminals 30 are arranged side by side in a direction perpendicular to the connector insertion-extraction direction.

In the following description, one of the two connection terminals 30 is described as a first connection terminal 30A while the other is described as a second connection terminal 30B if needed. In accordance with the description, the respective wires We are also described as follows. The wire We electrically connected to the first connection terminal 30A is described as a first wire WeA while the wire We electrically connected to the second connection terminal 30B is described as a second wire WeB. In the example, the first connection terminal 30A and the first wire WeA are indirectly electrically connected with a first coupling conductor 60, which is described below, for example, while the second connection terminal 30B and the second wire WeB are directly electrically connected. The second connection terminal 30B is physically and electrically connected to a core wire at the end of the second wire WeB in a certain connection manner such as crimping or welding.

The connector 1 in the embodiment includes a circuit protection component 40 inside the housing body 10 (refer to FIGS. 2 and 3). The circuit protection component 40 is interposed between the connection terminal 30 and the wire We in such a manner that the circuit protection component 40 is connected to them in series inside the housing body 10, and protects a circuit. In the example, the circuit protection component 40 is interposed between the first connection terminal 30A and the first wire WeA.

Figure 4:
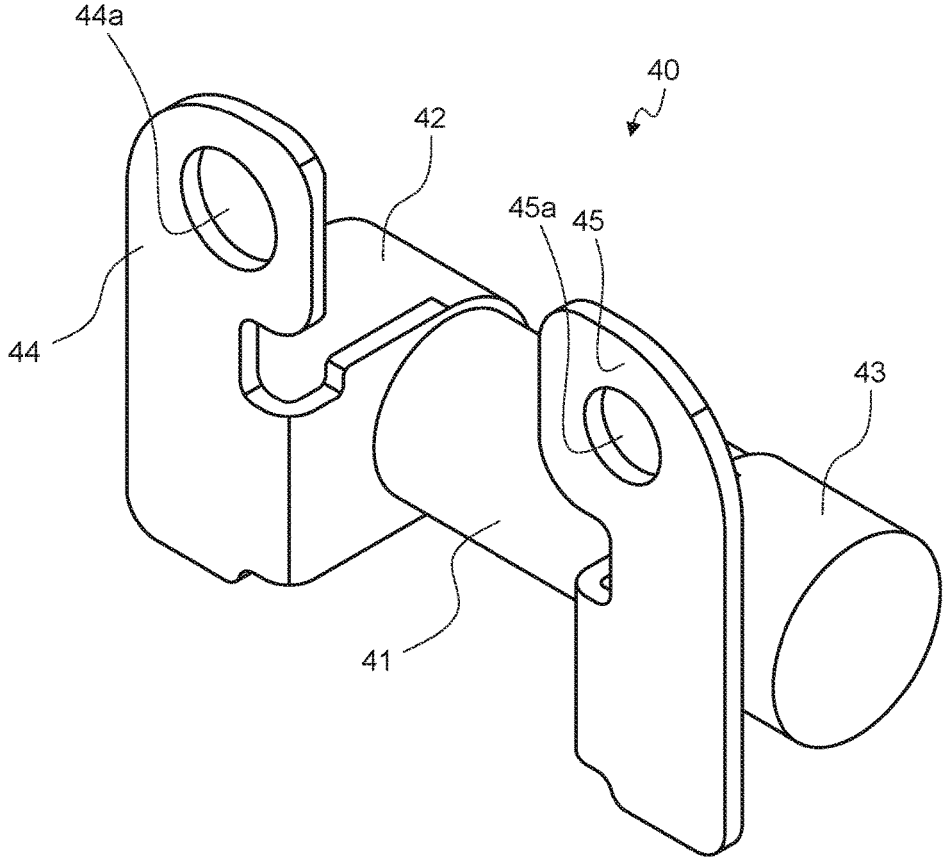
FIG. 4 is a perspective view illustrating a circuit protection component.

The circuit protection component 40 includes a main body 41, a first conductor 42, and a second conductor 43 (refer to FIG. 4). The main body 41 includes a circuit protector (not illustrated) that protects the circuit. The first conductor 42 is electrically connected to one end (one end on an energizing path) of the circuit protector and is electrically connected to the first connection terminal 30A. The second conductor 43 is electrically connected to the other end (the other end on the energizing path) of the circuit protector and is electrically connected to the first wire WeA. In the example, the circuit protection component 40 is a fuse. The main body 41 exemplarily illustrated herein includes a cylindrical container formed from an insulating material having light transmission property and a fusible element serving as the circuit protector disposed inside the container. Each of the first conductor 42 and the second conductor 43 exemplarily illustrated herein is formed from a conductive material such as metal in a cylindrical shape. The first conductor 42 is disposed at one end of the main body 41 while the second conductor 43 is disposed at the other end of the main body 41. The first conductor 42 and the second conductor 43 are each disposed along the arrangement direction of the corresponding connection terminal 30.

When the circuit protection component 40 is energized, the circuit protector, the first conductor 42, and the second conductor 43 become heat generation sources. The connector 1 in the embodiment, thus, provides, to the housing body 10, a heat dissipation structure that externally releases heat of the circuit protection component 40. The housing body 10 in the embodiment includes, on its inner wall, at least one thermal conductor 50 that performs thermal conduction with the circuit protection component 40 by being in contact with the circuit protection component 40 (refer to FIG. 2, and FIGS. 5 and 6). In the connector 1, when a temperature of heat of the circuit protection component 40 is higher than that of the thermal conductor 50, heat is conducted to the inner wall of the housing body 10 via the thermal conductor 50. Heat being conducted to the inner wall disperses along the wall surface and is conducted to an outer wall of the housing body 10. As a result, the connector 1 can release heat to outside the housing body 10. In addition, in the connector 1, heat being conducted to the housing body 10 is also conducted to the inner wall of the shield shell 20. Heat being conducted to the inner wall of the shield shell 20 disperses along the wall surface and is also conducted to an outer wall of the shield shell 20. As a result, the connector 1 can release heat to outside the shield shell 20. In the connector 1, the housing body 10 and the shield shell 20, thus, preferably abut on each other. In this way, the connector 1 can externally release heat of the circuit protection component 40, thereby making it possible to reduce influence caused by heat generated in the circuit protection component 40 on peripheral components (e.g., the housing body 10, the connection terminals 30, and the wires We).

The following specifically describes the heat dissipation structure.

Figure 5:
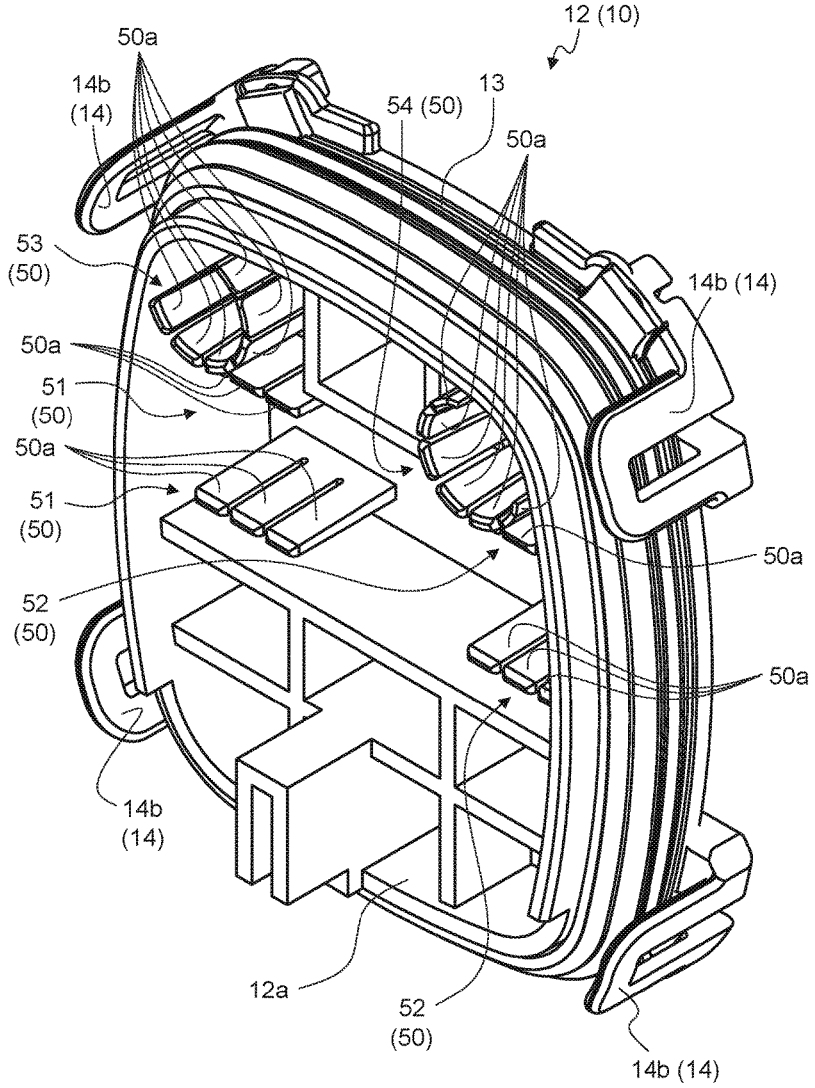
FIG. 5 is a perspective view illustrating a cover of a housing body.
Figure 6:
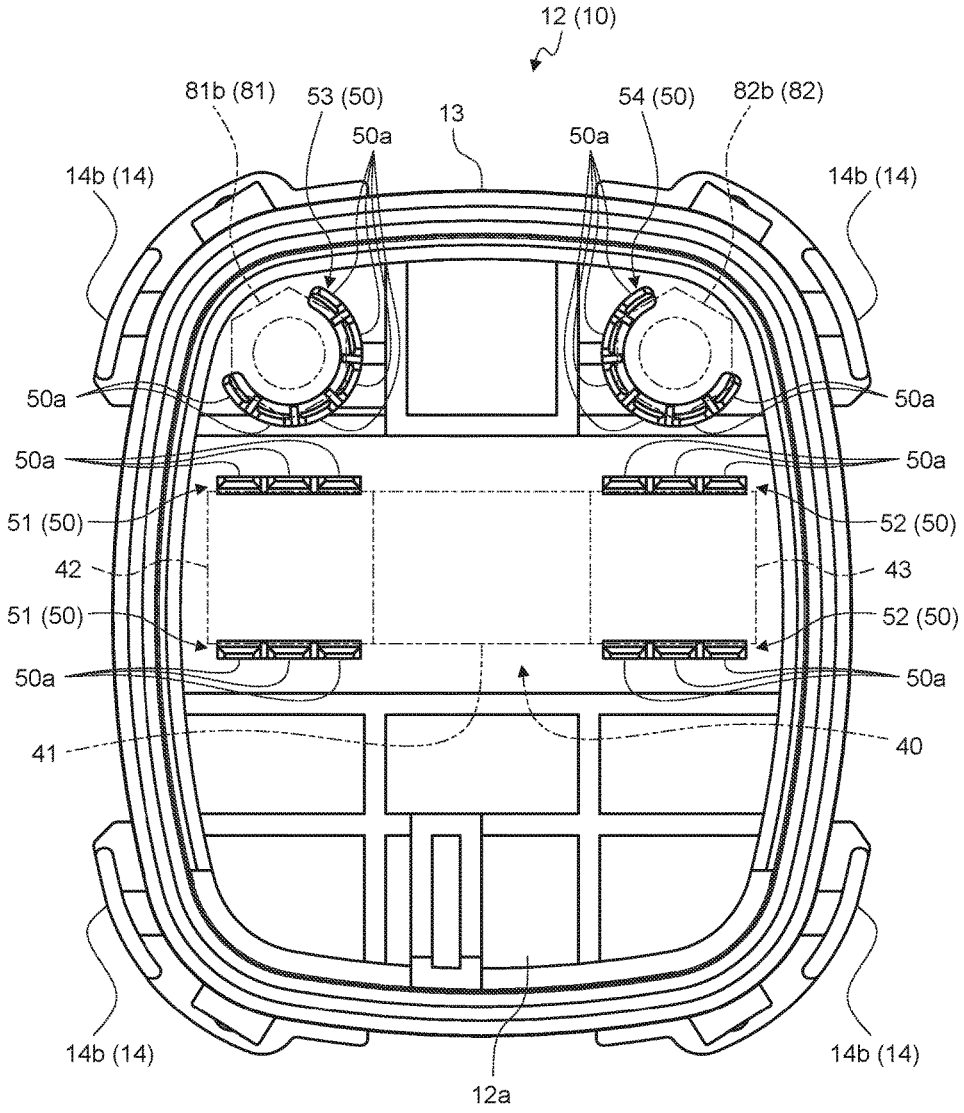
FIG. 6 is a front view illustrating the cover of the housing body.

In the connector 1 in the embodiment, the thermal conductor 50 is formed to have at least one elastic piece 50*a* so as to achieve a state in contact with the circuit protection component 40 and to maintain the contact state (refer to FIGS. 5 and 6). The elastic piece 50*a* is bent when being in contact with the circuit protection component 40.

In the connector 1 in the embodiment, the thermal conductor 50 is formed such that the thermal conductor 50 can receive heat of at least one of the first conductor 42 and the second conductor 43. The thermal conductor 50 may be formed so as to be capable of receiving heat of one of or both of the first conductor 42 and the second conductor 43. The thermal conductor 50 may be formed so as to be capable of receiving heat of one of the first conductor 42 and the second conductor 43, and heat of the main body 41. The thermal conductor 50 may be formed so as to be capable of receiving heat of both of the first conductor 42 and the second conductor 43, and heat of the main body 41.

The first conductor 42 and the second conductor 43 generate heat and also directly receive heat from the circuit protector. In the main body 41, heat of the circuit protector (fusible element) is conducted to the container via a gas layer. In the connector 1, for enhancing heat dissipation property, it is, thus, preferable to externally release heat of the first conductor 42 and the second conductor 43 rather than to release heat of the outer surface of the main body 41. In the connector 1, the thermal conductor 50 is, thus, formed so as to receive heat of at least one of the first conductor 42 and the second conductor 43 to enhance heat dissipation property. In the example, the thermal conductor 50 is formed so as to be capable of receiving heat of both of the first conductor 42 and the second conductor 43.

The connector 1 in the embodiment includes, inside the housing body 10, the first coupling conductor 60 that electrically couples the circuit protection component 40 to the first connection terminal 30A, and a second coupling conductor 70 that electrically couples the circuit protection component 40 to the first wire WeA (refer to FIGS. 2 and 3).

The first coupling conductor 60 physically and electrically connects to both of the first connection terminal 30A and the first conductor 42. This connection results in the first connection terminal 30A and the first conductor 42 being electrically coupled. The first coupling conductor 60 exemplarily illustrated herein includes a round terminal 61 formed from a conductive material such as metal and a wire (hereinafter, described as a "coupling wire") 62 that electrically couples the round terminal 61 to the first connection terminal 30A (refer to FIGS. 2 and 3). One end of a core wire of the coupling wire 62 is physically and electrically connected to the first connection terminal 30A while the other end of the core wire of the coupling wire 62 is physically and electrically connected to the round terminal 61. The connections may be made in a certain connection manner such as crimping or welding.

The second coupling conductor 70 physically and electrically connects to both of the first wire WeA and the second conductor 43. This connection results in the first wire WeA and the second conductor 43 being electrically coupled. The second coupling conductor 70 exemplarily illustrated herein is a round terminal 71 formed from a conductive material such as metal, and is physically and electrically connected to a core wire at the end of the first wire WeA (refer to FIGS. 2 and 3). The connection may be made in a certain connection manner such as crimping or welding.

In the connector 1 in the embodiment, the circuit protection component 40 further includes a first coupling portion 44 and a second coupling portion 45 (refer to FIGS. 2 to 4). The first coupling portion 44 is electrically connected to the first conductor 42, and electrically connected to the first coupling conductor 60. The second coupling portion 45 is electrically connected to the second conductor 43, and the second coupling conductor 70.

The first coupling portion 44 is a piece body that projects from the first conductor 42 such that a planer surface of the first coupling portion 44 is perpendicular to the connector insertion-extraction direction, and has a through hole 44*a* having an axial line coinciding with the connector insertion-extraction direction. In the connector 1, the through hole 44*a* and a through hole 61*a* of the round terminal 61 of the first coupling conductor 60 are coaxially arranged, and the first coupling portion 44 and the round terminal 61 are fixed by being tightened together with a joining member (hereinafter, described as a "terminal side joining member") 81 (refer to FIGS. 2 and 3). The terminal side joining member 81 is composed of a male screw member 81*a* fixed inside the housing portion 11 and a female screw member 81*b* screwed to the male screw member 81*a*. The male screw member 81*a* is inserted into the through holes 44*a* and 61*a*, and the female screw member 81*b* serving as a nut is screwed to the male screw portion of the male screw member 81*a* projecting through the through holes 44*a* and 61*a*. As a result, the first coupling portion 44 and the round terminal 61 are fixed by being tightened together. Inside the housing body 10, the terminal side joining member 81 joins the first coupling conductor 60 and the first coupling portion 44.

The second coupling portion 45 is a piece body that projects from the second conductor 43 such that a planer surface of the second coupling portion 45 is perpendicular to the connector insertion-extraction direction, and has a through hole 45*a* having an axial line coinciding with the connector insertion-extraction direction. In the connector 1, the through hole 45*a* and a through hole 71*a* of the round terminal 71 of the second coupling conductor 70 are coaxially arranged, and the second coupling portion 45 and the round terminal 71 are fixed by being tightened together with a joining member (hereinafter, described as a "wire side joining member") 82 (refer to FIGS. 2 and 3). The wire side joining member 82 is composed of a male screw member 82*a* fixed inside the housing portion 11 and a female screw member 82*b* screwed to the male screw member 82*a*. The male screw member 82*a* is inserted into the through holes 45*a* and 71*a*, and the female screw member 82*b* serving as a nut is screwed to the male screw portion of the male screw member 82*a* projecting through the through holes 45*a* and 71*a*. As a result, the second coupling portion 45 and the round terminal 71 are fixed by being tightened together. Inside the housing body 10, the wire side joining member 82 joins the second coupling conductor 70 and the second coupling portion 45.

The first coupling portion 44 and the second coupling portion 45 are each arranged along the arrangement direction of the corresponding connection terminal 30. The through hole 44*a* of the first coupling portion 44 and the through hole 45*a* of second coupling portion 45 are each arranged along the arrangement direction of the corresponding connection terminal 30.

The connector 1 thus structured includes, as the thermal conductors 50, first thermal conductors 51, second thermal conductors 52, a third thermal conductor 53, and a fourth thermal conductor 54 (refer to FIGS. 5 and 6). The first thermal conductors 51 receive heat of the first conductor 42 of the circuit protection component 40. The second thermal conductors 52 receive heat of the second conductor 43 of the circuit protection component 40. The third thermal conductor 53 receives heat of the first coupling portion 44 of the circuit protection component 40. The fourth thermal conductor 54 receives heat of the second coupling portion 45 of the circuit protection component 40.

The first thermal conductor 51 is formed such that the first thermal conductor 51 can directly receive heat of the first conductor 42 by being in contact with the first conductor 42. The first thermal conductor 51 has a flat plate shape and projects from the inner wall of the cover 12 toward the connector insertion direction. The first thermal conductor 51 is disposed such that the plane is along the connector insertion-extraction direction and the axial line direction of the first conductor 42 (i.e., in the arrangement direction of the corresponding connection terminal 30). The first thermal conductor 51 has a plurality of elastic pieces 50*a* arranged with a notch formed along the connector insertion-extraction direction therebetween along the axial line direction of the first conductor 42. The notches cause the elastic pieces 50*a* to have the ends in the projection direction as free ends. The first thermal conductor 51 exemplarily illustrated herein has three elastic pieces 50*a*.

The connector 1 in the embodiment includes two first thermal conductors 51 arranged with a distance therebetween in a direction perpendicular to both of the connector insertion-extraction direction and the axial line direction of the first conductor 42. The first thermal conductors 51 sandwich the first conductor 42 (refer to FIG. 6). The distance is smaller than the diameter of the first conductor 42 as far as the first thermal conductors 51 are not plastically deformed when the first thermal conductors 51 sandwich the first conductor 42, for example. As a result, in the connector 1, when the cover 12 is being fitted to the housing portion 11, the elastic pieces 50*a* of the respective first thermal conductors 51 are being bent while the first conductor 42 is being moved between the two first thermal conductors 51. As a result, in the connector 1, the first conductor 42 and the two first thermal conductors 51 are in contact with each other and the contact state is maintained. In the connector 1, when a temperature of heat of the first conductor 42 is higher than those of the first thermal conductors 51, heat can be conducted to the inner wall of the housing body 10 via the two first thermal conductors 51.

The second thermal conductor 52 has the same structure as the first thermal conductor 51, and can directly receive heat of the second conductor 43. Two second thermal conductors 52 are provided in the same arrangement as the first thermal conductors 51 such that the second thermal conductors 52 can sandwich the second conductor 43 (refer to FIG. 6). In the connector 1, when the cover 12 is being fitted to the housing portion 11, the three elastic pieces 50*a* of the respective second thermal conductors 52 are being bent while the second conductor 43 is being moved between the two second thermal conductors 52. As a result, in the connector 1, the second conductor 43 and the two second thermal conductors 52 are in contact with each other and the contact state is maintained. In the connector 1, when a temperature of heat of the second conductor 43 is higher than those of the second thermal conductors 52, heat can be conducted to the inner wall of the housing body 10 via the two second thermal conductors 52.

The third thermal conductor 53 is formed such that the third thermal conductor 53 can indirectly receive heat of the first coupling portion 44 via the terminal side joining member 81 by being in contact with the terminal side joining member 81. In the example, the third thermal conductor 53 is in contact with the female screw member 81*b* of the terminal side joining member 81. The third thermal conductor 53 has a plurality of elastic pieces 50*a* projecting from the inner wall of the cover 12 toward the connector insertion direction. The elastic pieces 50*a* are arranged side by side around the axial line of the female screw member 81*b* housed inside the housing body 10. The elastic pieces 50*a* are arranged such that the planes of the elastic pieces 50*a* are perpendicular to a direction perpendicular to the axial line of the female screw member 81*b*. The respective elastic pieces 50*a* are arranged around the axial line of the female screw member 81*b* with a distance between the elastic pieces 50*a* such that arranged elastic pieces 50*a* form an arc shape or a tubular shape coaxial with the axial line of the female screw member 81*b*. The respective elastic pieces 50*a* are arranged such that they laterally surround a part of or the whole of the head of the female screw member 81*b* (refer to FIG. 6). The elastic pieces 50*a* are arranged such that the outer diameter of a cylindrical virtual space inside the arc shape or the tubular shape is smaller than a maximum outer diameter of the head of the female screw member 81*b* as far as the respective elastic pieces 50*a* are not plastically deformed when the respective elastic pieces 50*a* surround the head of the female screw member 81*b*. In the example, the respective elastic pieces 50*a* are arranged such that the arranged elastic pieces 50*a* form an arc shape.

In the connector 1, when the cover 12 is being fitted to the housing portion 11, the respective elastic pieces 50*a* of the third thermal conductor 53 are being bent while the head of the female screw member 81*b* is being moved in a space formed inside the respective elastic pieces 50*a* of the third thermal conductor 53. As a result, in the connector 1, the female screw member 81*b* and the third thermal conductor 53 are in contact with each other and the contact state is maintained. In the connector 1, heat of the first coupling portion 44 is conducted to the female screw member 81*b* and when a temperature of heat of the female screw member 81*b* is higher than that of the third thermal conductor 53, heat of the female screw member 81*b* is conducted to the inner wall of the housing body 10 via the third thermal conductor 53. The connector 1 can indirectly conduct heat of the first coupling portion 44 to the inner wall of the housing body 10. The third thermal conductor 53 may be formed such that the third thermal conductor 53 can directly receive heat of first coupling portion 44 by being in contact with first coupling portion 44.

The fourth thermal conductor 54 has the same structure as the third thermal conductor 53, and can indirectly receive heat of the second coupling portion 45 via the wire side joining member 82. In the fourth thermal conductor 54, the respective elastic pieces 50*a* are arranged in an arc shape or a tubular shape (in this case, in an arc shape) so as to surround laterally the head of the female screw member 82*b* of the wire side joining member 82 in the same manner as the third thermal conductor 53 (refer to FIG. 6). In the connector 1, when the cover 12 is being fitted to the housing portion 11, the respective elastic pieces 50*a* of the fourth thermal conductor 54 are being bent while the head of the female screw member 82*b* is being moved in a space formed inside the respective elastic pieces 50*a* of the fourth thermal conductor 54. As a result, in the connector 1, the female screw member 82*b* and the fourth thermal conductor 54 are in contact with each other and the contact state is maintained. In the connector 1, heat of the second coupling portion 45 is conducted to the female screw member 82*b* and when a temperature of heat of the female screw member 82*b* is higher than that of the fourth thermal conductor 54, heat of the female screw member 82*b* is conducted to the inner wall of the housing body 10 via the fourth thermal conductor 54. The connector 1 can indirectly conduct heat of the second coupling portion 45 to the inner wall of the housing body 10. The fourth thermal conductor 54 may be formed such that the fourth thermal conductor 54 can directly receive heat of the second coupling portion 45 by being in contact with the second coupling portion 45.

The connector 1 in the embodiment can conduct heat of the circuit protection component 40 to the inner wall of the housing body 10 via the first thermal conductors 51, the second thermal conductors 52, the third thermal conductor 53, and the fourth thermal conductor 54. The connector 1 can externally release heat via the housing body 10 and the shield shell 20, thereby making it possible to reduce influence caused by heat of the circuit protection component 40 on the peripheral components. In the connector 1, the first thermal conductors 51, the second thermal conductors 52, the third thermal conductor 53, and the fourth thermal conductor 54 are arranged so as to receive heat of at least one of the first conductor 42 and the second conductor 43. The connector 1, thus, is capable of improving heat dissipation property in comparison with a conventional connector that releases only heat of the outer surface of the main body 41. In addition, the connector 1 includes the first thermal conductors 51, the second thermal conductors 52, the third thermal conductor 53, and the fourth thermal conductor 54 that are formed integrally with the cover 12, thereby requiring no dedicated components for releasing heat. The connector 1 in the embodiment can achieve heat dissipation property while preventing an increase in the number of components for releasing heat, and further prevent deterioration of assembly workability.

The connector according to the embodiment can conduct heat of the circuit protection component to the inner wall of the housing body via the thermal conductors provided to the housing body. The connector thus structured can release heat externally via the housing body and the shield shell, thereby making it possible to reduce influence caused by heat of the circuit protection component on the peripheral components. In addition, the connector provides the thermal conductors integrally formed with the housing body, thereby requiring no dedicated components for releasing heat. The connector, thus, can achieve heat dissipation property while preventing an increase in the number of components for releasing heat.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a housing body;

a shield shell that externally covers the housing body;

a connection terminal that is housed in the housing body, the connection terminal being electrically connected to a wire in the housing body, and electrically connected to a counterpart terminal when the connector is connected to a counterpart connector; and a circuit protection component that is interposed, in the housing body, between the connection terminal and the wire, and connects the connection terminal and the wire in series to protect a circuit, wherein the housing body includes an inner wall, and at least one thermal conductor that projects away from the inner wall and terminates at a free end, the thermal conductor contacts the circuit protection component, and the thermal conductor is configured to perform thermal conduction with the circuit protection component.

2. The connector according to claim 1, wherein the thermal conductor includes at least one elastic piece that is bent when the elastic piece is in contact with the circuit protection component.

3. The connector according to claim 2, further comprising:

a first coupling conductor that electrically couples the circuit protection component to the connection terminal; and a second coupling conductor that electrically couples the circuit protection component to the wire, wherein the circuit protection component includes a main body including a circuit protector, a first conductor that is electrically connected to the circuit protector and electrically connected to the first coupling conductor, and a second conductor that is electrically connected to the circuit protector and electrically connected to the second coupling conductor, and the thermal conductor is formed such that the thermal conductor is capable of receiving heat of at least one of the first and the second conductors.

4. The connector according to claim 3, wherein the circuit protection component is a fuse.

5. The connector according to claim 2, wherein the circuit protection component is a fuse.

6. The connector according to claim 1, further comprising:

a first coupling conductor that electrically couples the circuit protection component to the connection terminal; and a second coupling conductor that electrically couples the circuit protection component to the wire, wherein the circuit protection component includes a main body including a circuit protector, a first conductor that is electrically connected to the circuit protector and electrically connected to the first coupling conductor, and a second conductor that is electrically connected to the circuit protector and electrically connected to the second coupling conductor, and the thermal conductor is formed such that the thermal conductor is capable of receiving heat of at least one of the first and the second conductors.

7. The connector according to claim 6, wherein the circuit protection component is a fuse.

8. The connector according to claim 1, wherein the circuit protection component is a fuse.

9. A connector comprising:

a housing body;

a shield shell that externally covers the housing body;

a connection terminal that is housed in the housing body, the connection terminal being electrically connected to a wire in the housing body, and electrically connected to a counterpart terminal when the connector is connected to a counterpart connector; and a circuit protection component that is interposed, in the housing body, between the connection terminal and the wire, and connects the connection terminal and the wire in series to protect a circuit, wherein the housing body includes at least one thermal conductor that performs thermal conduction with the circuit protection component by being in contact with the circuit protection component, and the connector further comprising:

a first coupling conductor that electrically couples the circuit protection component to the connection terminal; and a second coupling conductor that electrically couples the circuit protection component to the wire, wherein the circuit protection component includes a main body including a circuit protector, a first conductor that is electrically connected to the circuit protector, a second conductor that is electrically connected to the circuit protector, a first coupling portion that is electrically connected to the first conductor and the first coupling conductor, and a second coupling portion that is electrically connected to the second conductor and the second coupling conductor, and the thermal conductor includes a first thermal conductor to which heat of the first conductor is conducted, a second thermal conductor to which heat of the second conductor is conducted, a third thermal conductor to which heat of the first coupling portion is conducted, and a fourth thermal conductor to which heat of the second coupling portion is conducted.

10. The connector according to claim 9, further comprising:

a terminal side joining member that joins the first coupling conductor to the first coupling portion; and a wire side joining member that joins the second coupling conductor to the second coupling portion, wherein the first thermal conductor is in contact with the first conductor, the second thermal conductor is in contact with the second conductor, the third thermal conductor is in contact with the terminal side joining member, and the fourth thermal conductor is in contact with the wire side joining member.

11. The connector according to claim 10, wherein the circuit protection component is a fuse.

12. The connector according to claim 9, wherein the circuit protection component is a fuse.

13. A connector comprising:

a housing body;

a shield shell that externally covers the housing body;

a connection terminal that is housed in the housing body, the connection terminal being electrically connected to a wire in the housing body, and electrically connected to a counterpart terminal when the connector is connected to a counterpart connector; and a circuit protection component that is interposed, in the housing body, between the connection terminal and the wire, and connects the connection terminal and the wire in series to protect a circuit, wherein the housing body includes at least one thermal conductor that performs thermal conduction with the circuit protection component by being in contact with the circuit protection component, and the thermal conductor includes at least one elastic piece that is bent when the elastic piece is in contact with the circuit protection component, and the connector further comprising:

a first coupling conductor that electrically couples the circuit protection component to the connection terminal; and a second coupling conductor that electrically couples the circuit protection component to the wire, wherein the circuit protection component includes a main body including a circuit protector, a first conductor that is electrically connected to the circuit protector, a second conductor that is electrically connected to the circuit protector, a first coupling portion that is electrically connected to the first conductor and the first coupling conductor, and a second coupling portion that is electrically connected to the second conductor and the second coupling conductor, and the thermal conductor includes a first thermal conductor to which heat of the first conductor is conducted, a second thermal conductor to which heat of the second conductor is conducted, a third thermal conductor to which heat of the first coupling portion is conducted, and a fourth thermal conductor to which heat of the second coupling portion is conducted.

14. The connector according to claim 13, further comprising:

a terminal side joining member that joins the first coupling conductor to the first coupling portion; and a wire side joining member that joins the second coupling conductor to the second coupling portion, wherein the first thermal conductor is in contact with the first conductor, the second thermal conductor is in contact with the second conductor, the third thermal conductor is in contact with the terminal side joining member, and the fourth thermal conductor is in contact with the wire side joining member.

15. The connector according to claim 14, wherein the circuit protection component is a fuse.

16. The connector according to claim 13, wherein the circuit protection component is a fuse.

* * * * *